US009668527B2

(12) United States Patent
Maltese

(10) Patent No.: US 9,668,527 B2
(45) Date of Patent: Jun. 6, 2017

(54) PROMOTIONAL AND CONVERTIBLE MITTEN TO GLOVE

(71) Applicant: Smitten Sports, LLC, Dearborn, MI (US)

(72) Inventor: Michele Alexandria Maltese, Dearborn, MI (US)

(73) Assignee: SMITTEN SPORTS, LLC, Dearborn, MI (US)

( * ) Notice: Subject to any disclaimer, the term of this patent is extended or adjusted under 35 U.S.C. 154(b) by 772 days.

(21) Appl. No.: 13/834,923

(22) Filed: Mar. 15, 2013

(65) Prior Publication Data

US 2014/0259284 A1 Sep. 18, 2014

(51) Int. Cl.

| | |
|---|---|
| ***A41D 19/02*** | (2006.01) |
| ***A41D 19/00*** | (2006.01) |
| ***A41F 19/00*** | (2006.01) |
| ***G09F 3/00*** | (2006.01) |
| *A41D 19/01* | (2006.01) |

(52) U.S. Cl.

CPC ..... *A41D 19/0051* (2013.01); *A41D 19/0017* (2013.01); *A41D 19/0068* (2013.01); *A41D 19/0072* (2013.01); *A41D 19/01* (2013.01)

(58) Field of Classification Search

CPC ..... A41D 19/01; A41D 19/0051; A41D 19/0072; A41D 19/0017; A41D 19/68

USPC ..... 2/167, 169, 159, 163; 40/642.01

See application file for complete search history.

(56) References Cited

U.S. PATENT DOCUMENTS 2,995,845 A * 8/1961 Fraser ..... G09F 3/12 206/278
3,110,499 A * 11/1963 Boeskool ..... A63F 9/00 116/223
4,034,853 A 7/1977 Smith
4,094,120 A * 6/1978 Goncalves ..... B65D 75/04 229/87.16
4,131,952 A * 1/1979 Brenning, Jr. ..... A41D 19/015 2/124
4,476,588 A * 10/1984 Long ..... A41D 19/0068 2/159
4,587,672 A * 5/1986 Madnick ..... A41D 19/01535 2/158
4,651,350 A * 3/1987 Dawiedczyk ..... A41D 19/0017 2/158
4,677,697 A * 7/1987 Hayes ..... A41D 19/0068 2/159
4,791,682 A * 12/1988 Herr ..... A41D 19/01 2/159
5,134,746 A * 8/1992 William ..... A47L 13/10 15/227
5,193,676 A * 3/1993 Gold ..... B65D 73/0064 206/292
D366,131 S * 1/1996 Smith ..... D2/610
5,636,381 A * 6/1997 Brogden ..... A63B 71/148 2/161.1

(Continued)

*Primary Examiner* — Anna Kinsaul
*Assistant Examiner* — Cameron A Carter
(74) *Attorney, Agent, or Firm* — Reising Ethington, P.C.

(57) ABSTRACT

A pair of disposable hand coverings has a body formed of a front film layer and back film layer sealed together about a periphery to form a pair of opposing hand coverings each having a finger section at opposite closed ends and each having a wrist section with at least one line of weakening at the wrist sections to ease separating each of the pair of hand coverings.

18 Claims, 7 Drawing Sheets

(56) References Cited

U.S. PATENT DOCUMENTS 5,734,991 A 4/1998 Schmid
5,806,099 A * 9/1998 Grinberg ..... A41D 19/0068 2/158
5,836,828 A * 11/1998 Sinton ..... A63B 69/3608 2/161.2
5,966,741 A 10/1999 Klecina
6,338,163 B1 * 1/2002 Markson ..... A41D 19/0017 2/161.6
6,488,147 B2 * 12/2002 Mattesky ..... B65D 73/0014 206/278
6,618,860 B1 * 9/2003 Sullivan ..... A63B 71/141 2/159
6,637,035 B1 * 10/2003 Brinkmann ..... A41D 19/01 15/227
6,694,653 B2 * 2/2004 Bradfield ..... G08B 13/2434 40/642.01
6,729,979 B1 * 5/2004 Sullivan ..... A63B 69/0059 2/161.1
D546,384 S 7/2007 Connors
7,578,006 B2 * 8/2009 Garneau ..... A63B 71/14 2/159
D610,776 S * 3/2010 Walker ..... D2/622
7,908,673 B2 * 3/2011 Kerr-Maddox .... A41D 19/0034 2/163
D652,609 S * 1/2012 Walker ..... D2/621
8,272,562 B2 * 9/2012 Ziegler ..... G09F 3/0335 235/375
2003/0180541 A1 9/2003 Naik et al.
2004/0025221 A1 * 2/2004 Clark ..... A41D 19/0006 2/159
2004/0068778 A1 4/2004 Van Veghel et al.
2004/0107476 A1 * 6/2004 Goldwitz ..... A41D 19/015 2/159
2004/0172735 A1 * 9/2004 Garland ..... A41D 19/0041 2/160
2005/0066413 A1 * 3/2005 Mattesky ..... A47G 25/904 2/161.6
2005/0204452 A1 * 9/2005 Yung ..... A41D 19/0055 2/167
2007/0150996 A1 * 7/2007 McCarville ..... A41D 19/0072 2/159
2007/0150998 A1 * 7/2007 Atherton ..... A63B 71/146 2/159
2008/0172767 A1 * 7/2008 Friedstrom ..... A47K 7/02 2/16
2008/0244809 A1 * 10/2008 Hassan et al. ..... A41D 19/0058 2/161.8
2009/0045085 A1 * 2/2009 Vax ..... B65D 85/18 206/296
2009/0313742 A1 * 12/2009 Smeltzer ..... A41D 27/28 2/161.2
2011/0072694 A1 3/2011 Bowen et al.
2011/0223378 A1 * 9/2011 Bauer ..... A41D 27/08 428/124
2011/0271418 A1 11/2011 Crockett-Grabus

* cited by examiner

PROMOTIONAL AND CONVERTIBLE MITTEN TO GLOVE

TECHNICAL FIELD

The field of this invention relates to film made plastic hand coverings in the shape of mittens or gloves.

BACKGROUND OF THE DISCLOSURE

Plastic film hand coverings in the form of mittens and gloves are widely used for food handling, patient handling, clean up, fun or for promotions. Typically, these plastic hand coverings are meant for single or short term use and thus, preferably, are made inexpensively from film based plastics.

Often, a pair of hand coverings i.e. a left and right hand covering are attached together at their respective wrist sections with separation facilitated by a laterally extending perforation line at a midsection.

What is needed is a pair of hand coverings that have features that keep the interest of the wearer made for promotions and for fun that may include graphics depicted on the front and rear faces of the hand coverings, so that the hand covering is retained on the hands for longer periods of time and any separated midsection is also retained. Such features may include structural features besides graphic printing.

SUMMARY OF THE DISCLOSURE

In accordance with one aspect of the invention, a pair of disposable hand coverings has a body formed of a front film layer and back film layer sealed together about a periphery to form a pair of opposing hand coverings. Each hand covering has a finger section at opposite closed ends and a wrist section joined together by a midsection. Preferably, the shape is in the form of a mitten.

The midsection is defined by two longitudinally spaced apart laterally extended lines of weakening, preferably, in the form of perforations for separation from the respective wrist sections of the pair of hand coverings. The midsection may have one of promotional and informative material printed thereon as an incentive to retain the midsection after separation from the pair of disposable hand coverings.

Preferably, the midsection has holes located centrally along a longitudinal axis and equally spaced about a center line that laterally extends across the body such that when the body is folded in half along the center line, the holes align for receiving a mounting rack for hanging and display purposes. The midsection has weakening lines to separate into multiple different pieces for separate promotional or informative messages. Preferably, at least one of the lines of weakening is a perforation is along the center line.

In one embodiment, the finger section has longitudinally extending seams connecting of the front and back layers together forming individual finger pockets. Each seam has a line of weakening preferably, in the form of a perforation extending therealong to be tearable to form glove finger sections separated with closed edges. Each of the glove finger sections has lateral extending perforation lines of weakening to allow the glove finger sections to be torn and provide base portions. Preferably, a plurality of vent holes extend through at least one of the back and front film layers of the hand coverings for ventilation. At least one section of one of the front film layer and back film layer may have an autograph receptive coating.

BRIEF DESCRIPTION OF THE DRAWINGS

Reference now is made to the accompanying drawings in which.

DETAILED DESCRIPTION OF THE PREFERRED EMBODIMENT

Figure 1:
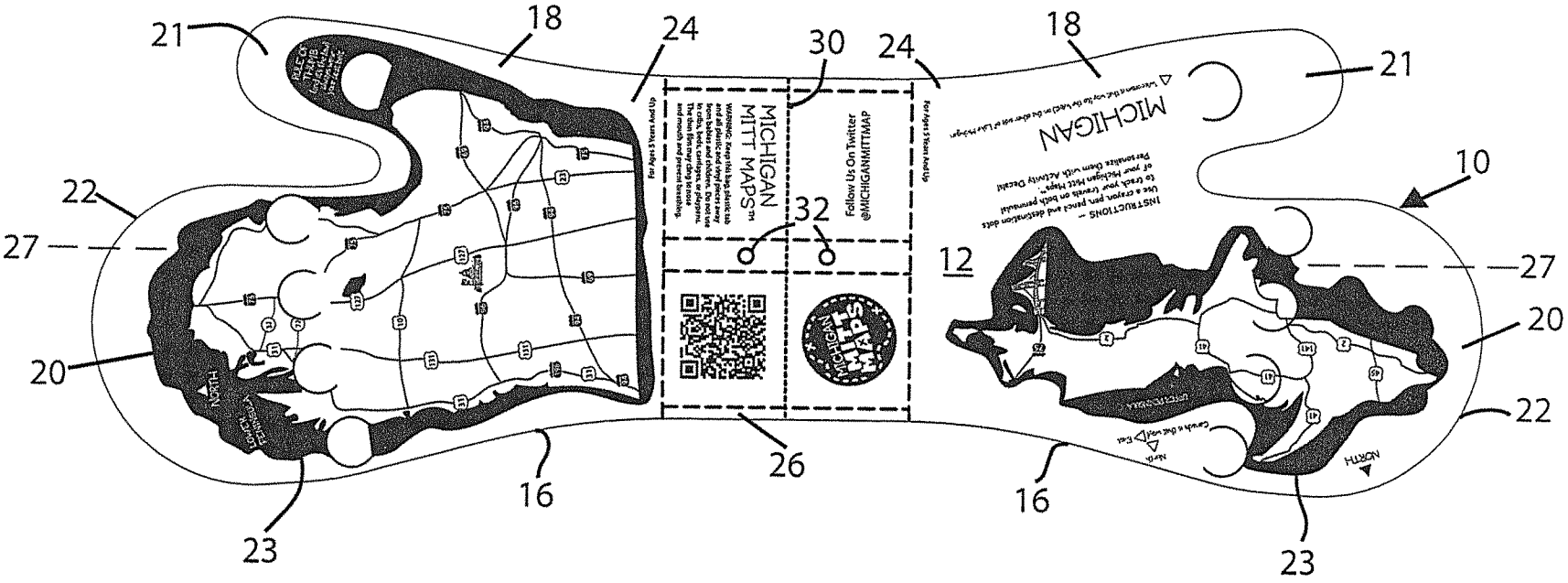
FIG. 1 is a top plan view of a pair of hand coverings according to one embodiment of the invention.
Figure 2:
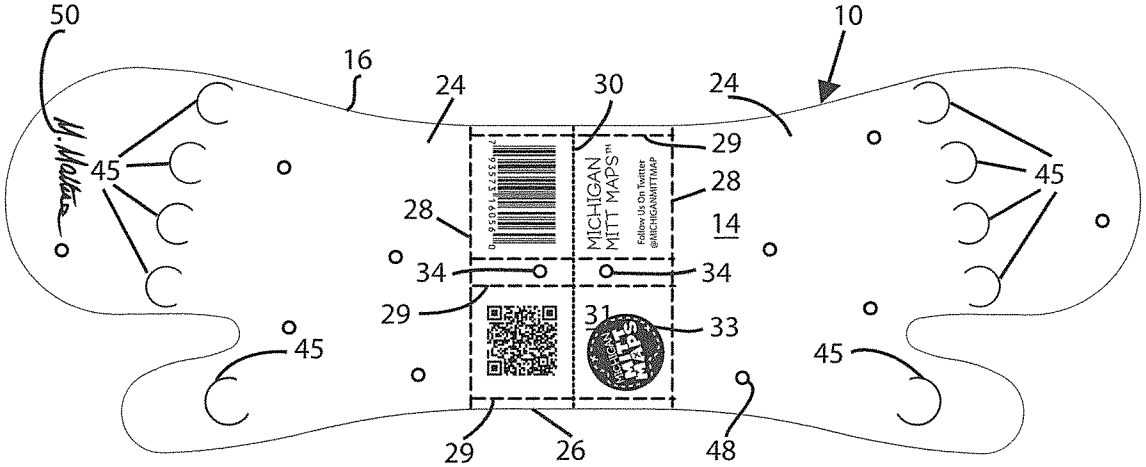
FIG. 2 is a bottom plan view of the hand coverings shown in FIG. 1.
Figure 3:
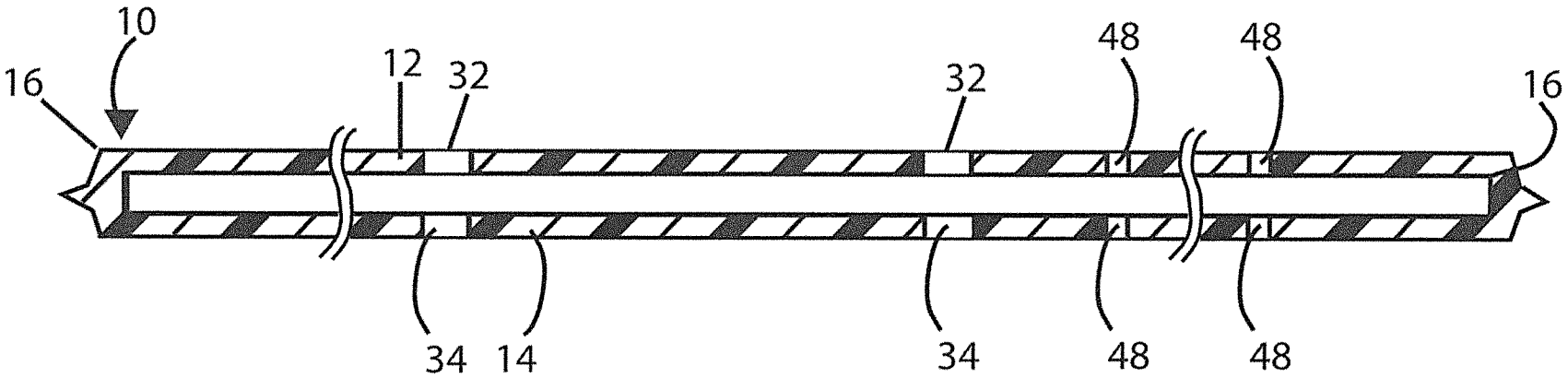
FIG. 3 is a segmented view illustrating the top and bottom film layers having a periphery seamed together.

Referring now to FIGS. 1-3, a film assembly 10 made from a front film layer 12 and a back film layer 14 sealed together about its periphery 16 such that a pair of hand coverings 18 each with a wrist section 24 and two opposite closed ends 22 forming a finger section 20. The finger section 20 may have a separated thumb 21. The films are a plastic material that can receive and hold printed graphic ink to form a graphic 23. A suitable plastic may be low density polyurethane and vinyl.

Each wrist section 24 is attached to a midsection 26. The midsection 24 is separated from each wrist section 24 through a pair of weakening lines 28 extending laterally across the assembly 10. As used herein, the term "weakening" may include perforation, trimmings or any other suitable weakening. Also the transverse center line 30 may be weakened. The midsection may also have additional weakening lines 29 to allow the midsection to be separated into smaller pieces 31. Each piece 31 may have graphics 33 printed thereon in the form or coupons, promotions, advertisements, riddles and answers or other information. The graphics 33 may also be printed on the inside surface. Such graphics 33 are to peak a user's interest so that the user retains possession of the midsection and is an incentive against immediate discarding of the midsection.

Apertures 32 extend through the front film layer 12 and apertures 34 extend through back film layer 14 and are aligned with the respective aperture 32. The apertures 32 and 34 are equally spaced from the center line 30 along a longitudinal axis 27 of the assembly 10. When the assembly 10 is folded in half along center line 30, all four holes 32 and 34 align to allow the assembly 10 to be mounted on a rack prong 35 for hanging and display purposes as shown in FIG. 4.

Figure 4:
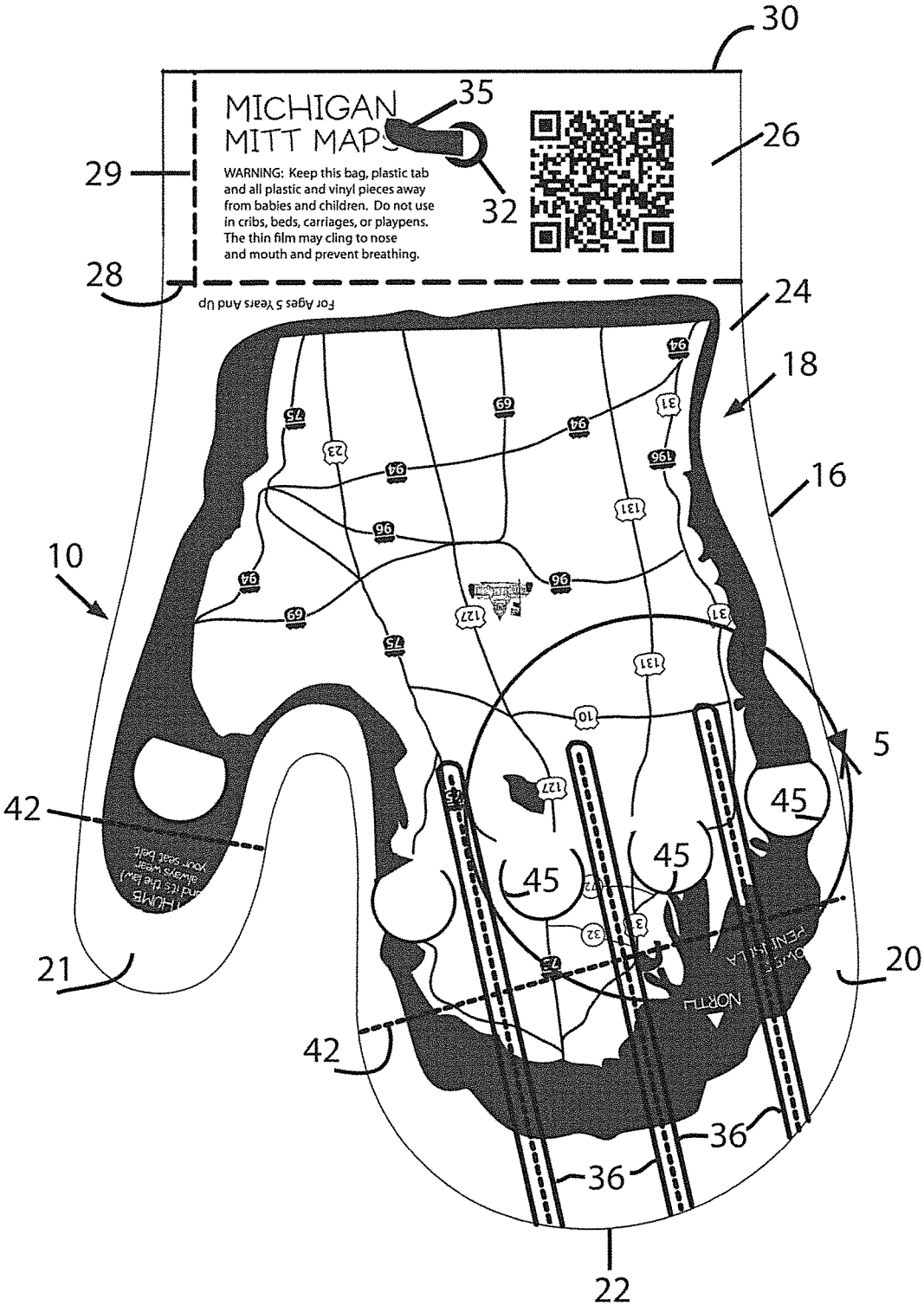
FIG. 4 shows the hand covering assembly folded in half and installed on a rack.
Figure 5:
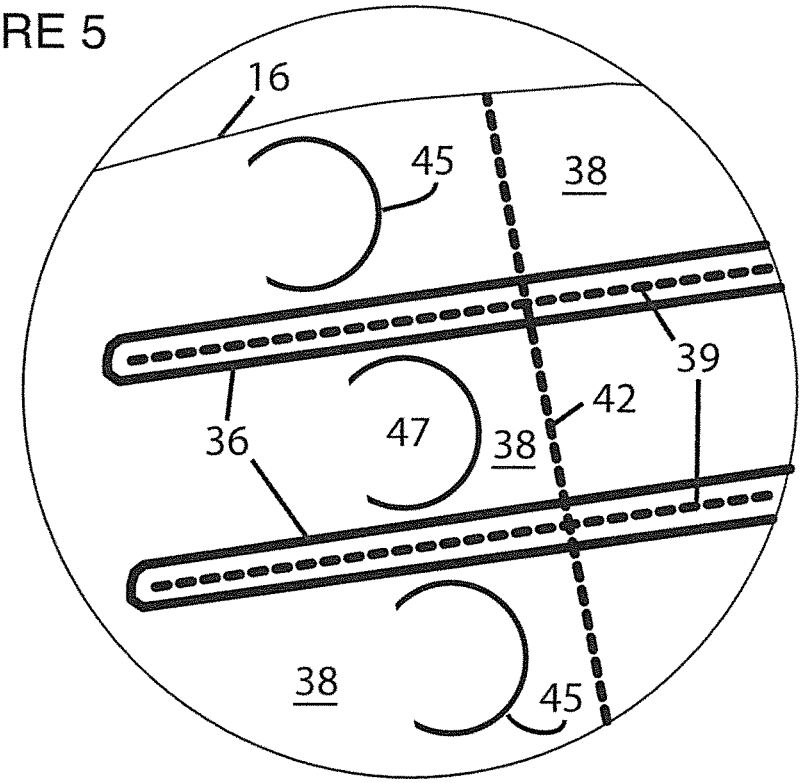
FIG. 5 is an enlarged sectional view taken along line 5 in FIG. 4 illustrating optional seams forming finger pockets and perforation lines in the seams.
Figure 6:
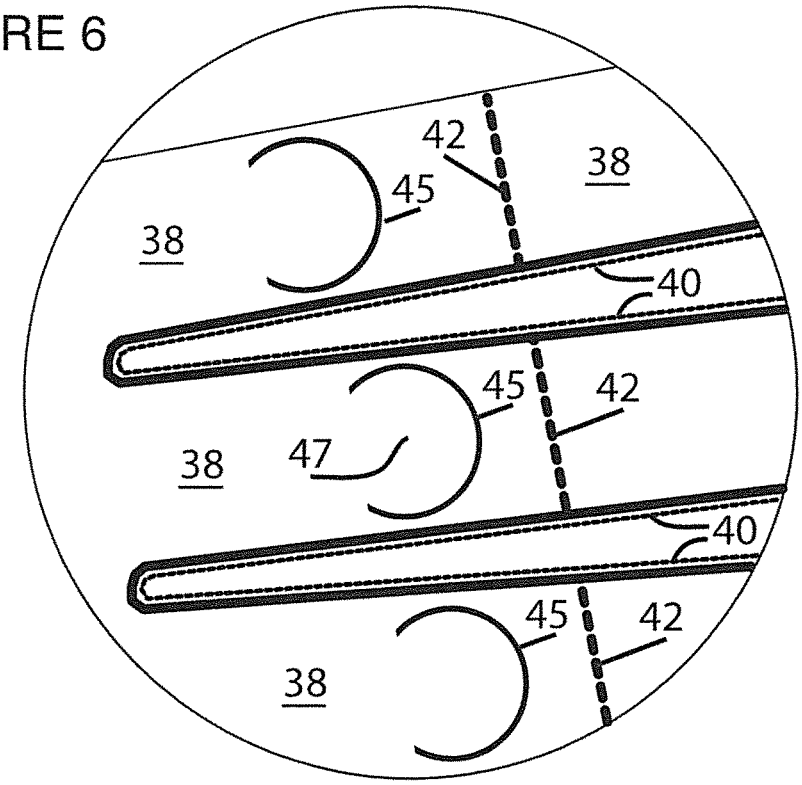
FIG. 6 is a view similar to FIG. 5 showing the perforation lines torn to separate the finger pockets with closed edges.

As illustrated in FIGS. 4 and 5, the finger section 20 may have several seams 36 extending through to form individual finger pockets 38. In addition each seam 36 as more clearly shown in FIG. 5 may have weakenings 39 centrally placed within the seam. In other words, the seam 36 has a width sufficient to accommodate tearing of the weakenings 39 wherein each finger pocket 38 maintains a closed edge 40 as shown in FIG. 6.

Figure 7:
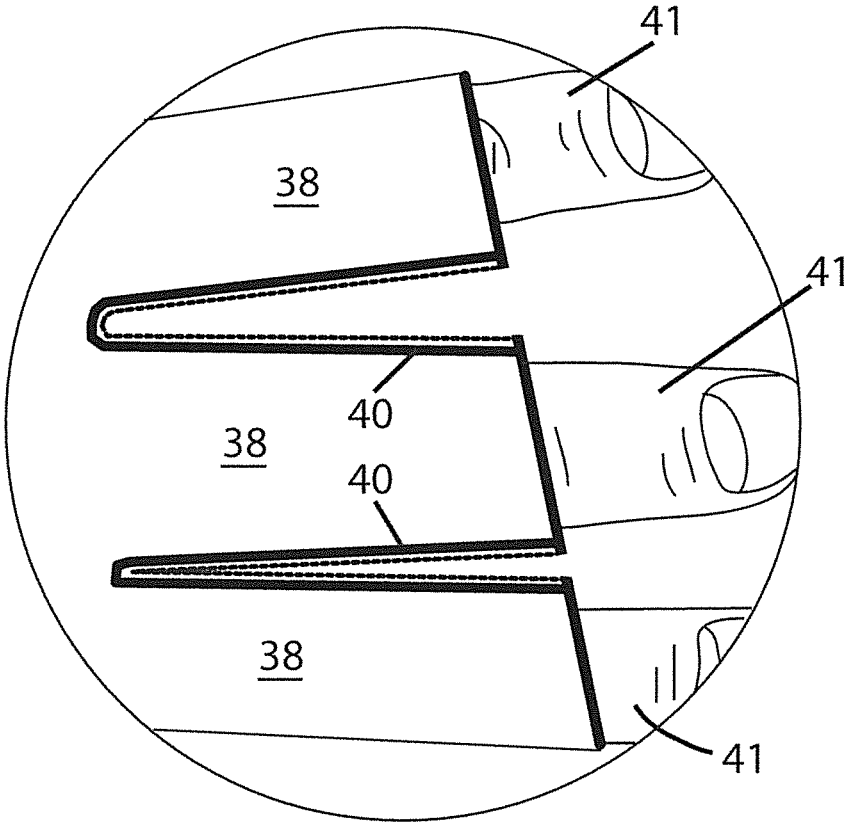
FIG. 7 is a view the hand covering used with the cross perforation 42 torn.
Figure 8:
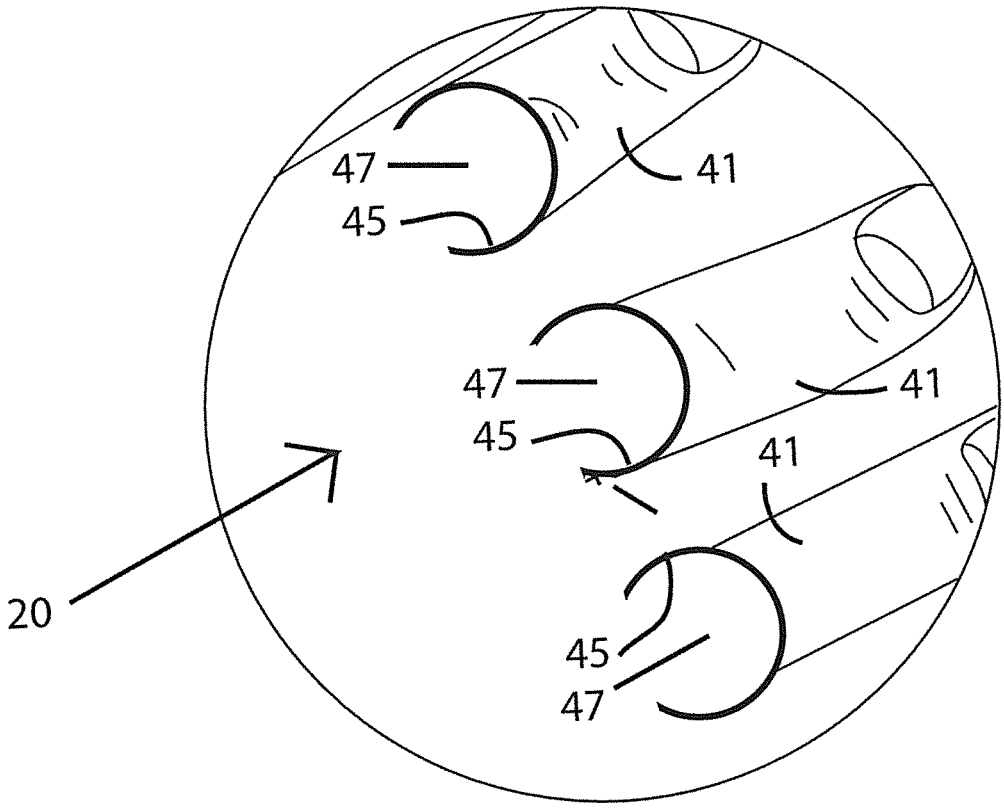
FIG. 8 is a view similar to FIG. 5 showing fingers 41 protruding from the arcuate cuts.

In addition, the finger pockets 38 may have cross weakenings 42 such that when cross weakenings 42 are torn, the user may expose portions of fingers 41 for more dexterity as illustrated in FIG. 7. The cross weakenings 42 are placed such that when torn, a base portion of the seam 36 remains on the hand covering to continue to provide the individual finger pockets 38. In addition, optional arcuate cuts 45 can be formed in the finger section 20 to allow fingers 41 to lift the flaps 47 formed by the cuts 45 and to protrude from the finger section 20 as illustrated in FIG. 8. The arcuate cuts 45 also allow ventilation to promote longer more comfortable wearing of the convertible hand covering 18. Optional vent holes 48 (FIG. 3) may also be placed throughout the hand covering for additional ventilation.

In this manner, the hand covering is convertible from a mitten type covering to a glove type covering that allows fingers to be exposed or covered. Furthermore, the hand coverings can also be converted to a cut-off glove type covering.

At least one face of one hand covering 18 may have a transparent autograph receptive coating thereon. This coating allows autographs 50 or other writings by ink pen or pencil thereon as illustrated in FIG. 2. A thin transparent urethane material may be suitable for an autograph receptive coating.

The hand coverings 18 as well as the midsection 26 may be printed with graphics 23 and 33 that may include promotional material as well as entertaining or informational material. Sport team logos, venue maps, game boards, the map of the State of Michigan as illustrated are various examples of graphics that may be printed on the hand coverings.

It should be understood that all the perforations may be replaced by other lines of weakening. For example, thinner seams of plastic or weaker seams of plastic of different material may also provide for the appropriate tearing.

Variations and modifications are possible without departing from the scope and spirit of the present invention as defined by the appended claims.

The embodiments in which an exclusive property or privilege is claimed are defined as follows:

1. A pair of disposable hand coverings, each one of the pair of disposable hand coverings comprising: a body formed of a front film layer and a back film layer; said front film layer and said back film layer sealed together about a periphery to form two opposing hand coverings each having a portion of the front film layer and a portion of the back film layer forming a respective finger section at opposite closed ends each finger section formed by sealed sides of a portion of said front film layer and a portion of said back film layer and each hand covering having a wrist section joined together by an integrally formed midsection made from portions of both of said front and back film layers; said midsection defined by two longitudinally spaced apart laterally extending lines of weakening for separation from said respective wrist sections of said pair of hand coverings; said disposable hand coverings having indicia material printed thereon, said midsection having indicia printed thereon as an incentive to retain said midsection after separation from said pair of disposable hand coverings; and said midsection having holes located centrally along a longitudinal axis that extends to each respective finger section with opposite closed ends and equally spaced about a center line that laterally extends across said body substantially perpendicular to the longitudinal axis such that when said body is folded in half along said center line with a hand covering defined at each half, said holes in portions of said front and back film layers at the midsection between said pair of hand coverings at one side of said center line being aligned with the holes in portions of said front and back film layers at the midsection at the other side of the center line for receiving a same single prong of a mounting rack for hanging and display purposed.

2. A pair of disposable hand coverings as defined in claim 1 further comprising:

said midsection having weakening lines to separate into multiple different pieces for separate messages formed by said indicia.

3. A pair of disposable hand coverings as defined in claim 2 further comprising: said weakening lines having at least one being a perforation line positioned along said center line; and said indicia material printed on said hand covering including a geographical shape of the state of Michigan.

4. A pair of disposable hand coverings as defined in claim 1 further comprising:

said finger section having longitudinally extending seams connecting said front and back layers together forming individual finger pockets.

5. A pair of disposable hand coverings as defined in claim 4 further comprising:

each seam having a line of weakening extending thereabong to be tearable to form glove finger sections separated with closed edges.

6. A pair of disposable hand coverings as defined in claim 5 further comprising:

each of said glove finger sections having lateral extending line of weakening to allow said glove finger sections to be torn and provide base portions.

7. A pair of disposable hand coverings as defined in claim 1 further comprising:

a plurality of arcuate cuts extending through at least one of the back and front film layers of the hand coverings for allowing fingers to protrude through and for ventilation.

8. A pair of disposable hand coverings as defined in claim 1 further comprising:

a plurality of vent holes extending through the back and front film layers of the hand coverings for ventilation.

9. A pair of disposable hand coverings as defined in claim 1 further comprising:

at least one section of one of said front film layer and back film layer having an autograph receptive coating.

10. A pair of disposable hand coverings, each one of the pair of disposable hand coverings comprising: a body formed of a front film layer and a back film layer sealed together about a periphery to form two opposing hand coverings each having a portion of a front film layer and a portion of a back film layer forming a respective finger section at opposite closed ends and each having sections joined at a midsection; said midsection defined by two longitudinally spaced apart laterally extending lines of weakening for separation from respective wrist sections of said pair of hand coverings; said disposable hand coverings having indicia material printed thereon, said midsection having indicia printed thereon as an incentive to retain said midsection after separation from said pair of disposable hand coverings; and said midsection having holes located centrally along a longitudinal axis that extends to each respective finger section with opposite closed ends and equally spaced about a center line that laterally extends across said body substantially perpendicular to the longitudinal axis such that when said body is folded in half along said center line with a hand covering defined at each half, said holes in portions of said front and back film layers at the midsection between said pair of hand coverings at one side of said center line being aligned with the holes in portions of said front and back film layers at the midsection at the other side of the center line for receiving a same single prong of a mounting rack for hanging and display purposed; and said finger section in the form of a mitten having longitudinally extending and laterally spaced seams connecting said portions of said front and back film layers together to form finger pockets within said finger section in the form of a mitten; and said weakening lines having at least one being a perforation line positioned along said center line; and said indicia material printed on said hand covering including a geographical shape of the state of Michigan.

11. A pair of disposable hand coverings as defined in claim 10 further comprising:

each seam having a weakening extending therealong to be tearable to form glove finger sections separated with closed edges from said finger section in the form of a mitten.

12. A pair of disposable hand coverings as defined in claim 11 further comprising:

each of said glove finger sections having lateral extending weakening to allow said glove finger sections at a distal end to be torn away from said hand coverings and provide base sections.

13. A pair of disposable hand coverings as defined in claim 10 further comprising:

a plurality of arcuate cuts extending through at least one of the back and front film layers of the hand coverings for allowing fingers to protrude through and for ventilation.

14. A pair of disposable hand coverings as defined in claim 10 further comprising:

a plurality of vent holes extending through the back and front film layers of the hand coverings for ventilation.

15. A pair of disposable hand coverings as defined in claim 10 further comprising:

holes located centrally along a longitudinal axis that extends to the respective finger sections with opposite closed ends and equally spaced about a center line that laterally extends across said body substantially perpendicular to the longitudinal axis such that when said body is folded in half along said center line, said holes align with each other for both receiving a same single prong of a mounting rack for hanging and display purposes.

16. A pair of disposable hand coverings as defined in claim 15 further comprising:

at least one section of one of said front film layer and back film layer having an autograph receptive coating.

17. A pair of disposable hand coverings as defined in claim 16 further comprising:

a plurality of arcuate cuts extending through at least one of the back and front film layers of the hand coverings for allowing fingers to protrude through and for ventilation.

18. A pair of disposable hand coverings as defined in claim 10 further comprising:

at least one section of one of said front film layer and back film layer having an autograph receptive coating.

* * * * *